US005221348A

United States Patent [19]

Masano

[11] Patent Number: 5,221,348

[45] Date of Patent: Jun. 22, 1993

[54] HIGH PRESSURE GLUE INJECTOR

[76] Inventor: Thomas C. Masano, 7702 Don Dr., Clinton, Md. 20735

[21] Appl. No.: 798,104

[22] Filed: Nov. 26, 1991

[51] Int. Cl.[5] ..... B05C 11/00

[52] U.S. Cl. ..... 118/506; 156/578; 144/330

[58] Field of Search ..... 118/506; 144/330, 344; 604/222, 218, 227; 156/578, 94; 222/386, 470, 469

[56] References Cited

U.S. PATENT DOCUMENTS

| | | | |
|---|---|---|---|
| 2,040,126 | 5/1936 | Grieve | 156/94 |
| 2,578,765 | 12/1951 | Wallace | 222/469 |
| 2,756,748 | 7/1956 | Ferguson | 604/222 |
| 2,882,899 | 4/1959 | Nogier et al. | 604/222 |
| 2,958,445 | 11/1960 | Jesse | 222/386 |
| 3,151,617 | 10/1964 | Baum | 604/222 |
| 3,212,685 | 10/1965 | Swan et al. | 222/386 |
| 3,352,336 | 11/1967 | Smith | 118/506 |
| 3,537,621 | 11/1970 | Jesse | 222/386 |
| 3,581,956 | 6/1971 | Reid | 604/222 |
| 4,030,498 | 6/1977 | Tompkins | 604/222 |
| 4,323,177 | 4/1982 | Nielsen | 222/386 |
| 4,687,472 | 8/1987 | Gross | 604/227 |
| 4,863,072 | 9/1989 | Perler | 604/222 |
| 4,925,449 | 5/1990 | Saez et al. | 604/227 |

*Primary Examiner*—W. Gary Jones
*Assistant Examiner*—Steven P. Griffin
*Attorney, Agent, or Firm*—Perry Carvellas

[57] ABSTRACT

A glue injector for injecting glue under high pressure is described that comprises a barrel (2), a plunger (3) that is received within the barrel and extends rearwardly through an aperture (19) in the body (4) of a handle which carries a pair of opposed finger grips (5, 6). The finger grips are located at the rear portion of the barrel and laterally of the barrel and are elongated so as to each accommodate two fingers. The plunger (3) comprises a shaft (12), a piston (13) at its front end and a head (14) at its back end. The piston includes a resilient disc, washer and bolt. The bolt is threadedly attached to the front end of the piston to provide with the resilient disc and washer a tight seal. The barrel has a tapered nozzle attached to its front end. The tapered nozzle is threadedly attached to the front end of the glue injector barrel.

9 Claims, 3 Drawing Sheets

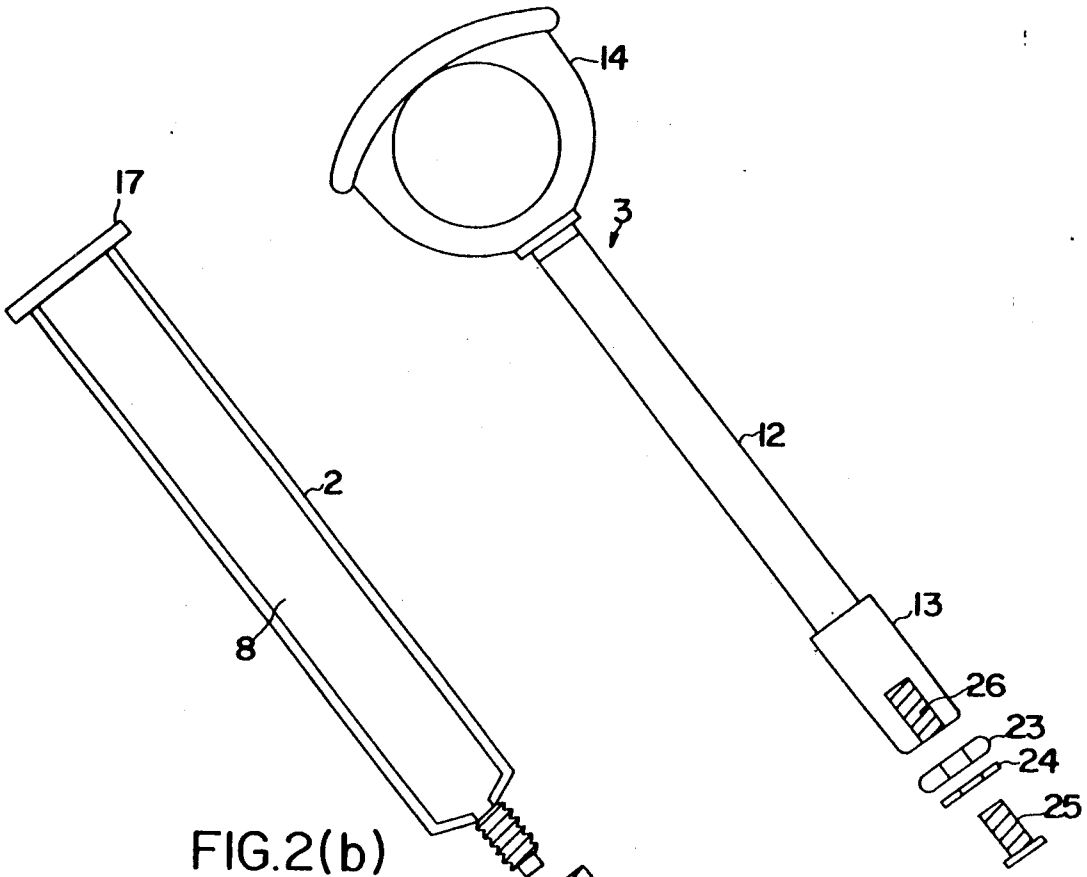
FIG.2(c)
FIG.2(b)
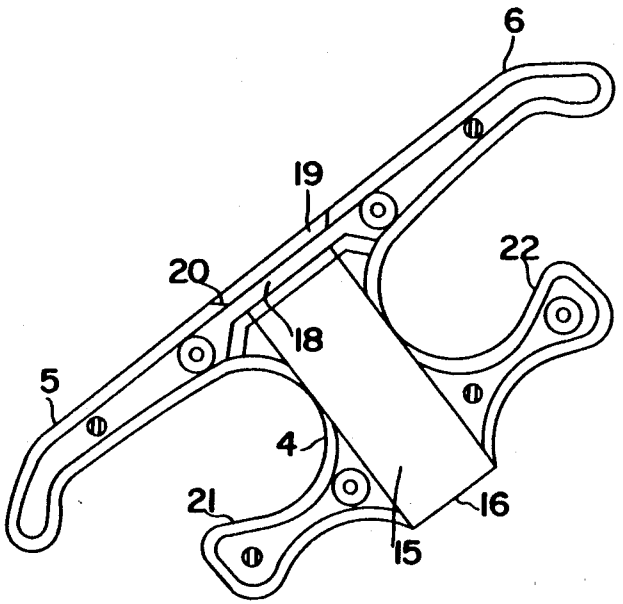
FIG.2(a)

HIGH PRESSURE GLUE INJECTOR

BRIEF DESCRIPTION OF THE INVENTION

The present invention relates to a high pressure glue injector for injecting glue into the joints of furniture or other difficult to reach areas of structures without the necessity of dismantling the furniture or structure.

The present invention more particularly relates to a hand held high pressure glue injector which comprises in combination means for providing glue at high pressure including elongated opposed finger grips, a plunger having a piston comprising a resilient disc and washer attached thereto by a threaded bolt, a tapered nozzle with a small orifice through which the glue is injected and means for removing the plunger from the glue injector.

BACKGROUND OF THE INVENTION

The present invention relates to the gluing or regluing of joints in furniture, cabinets and the like. More particularly, the invention relates to regluing and repairing of that type of joint used to glue together the various wooden parts of chairs, tables, beds and other types of furniture without having to take the furniture joint apart to effect the regluing and repair.

Heretofore it had been necessary, in order to obtain good repair of these types of joints, to take apart and dismantle the broken joint and to then apply a coat of glue to the dismantled parts of the joint and to reassemble the parts and permit the glue to set in order to join together the two parts to be repaired. This method of effecting repairs has made it necessary to dismantle the damaged joint from the remaining parts of the furniture, requiring the breaking and damage of joints to which the damaged parts are connected. This procedure further damages the furniture requiring repair and regluing, in some cases, three or four joints where only one joint initially required repair.

Attempts have been made to repair furniture without dismantling the joint by drilling a hole through the furniture into the joint to be repaired and to then inject glue into the hole and joint. The glue injectors that have been available for this purpose have not been able to either deliver the glue to the drilled hole at a sufficiently high pressure to reach the joint or have not been able to deliver sufficient glue to the joint or have been cumbersome and awkward to use and have taken a relatively long time to apply the glue.

Further, it has been a particularly difficult problem to deliver viscous glue to the areas to be repaired, to fill the glue injector with glue and to clean the glue injector after use.

Though there are various types of glue injectors available, none have been well received, commercially successful or particularly successful in use.

OBJECTS OF THE INVENTION

It is an object of the present invention to provide glue under pressure to a joint to be glued without the necessity of taking the joint apart.

Another object of the invention is to provide a high pressure glue injector with a shaped nozzle and piston to apply pressure to the glue to force it from the nozzle into an opening drilled for it in the furniture to be repaired.

Another object of the present invention is to provide an improved high pressure glue injector for gluing or regluing furniture joints and the like which may be carried out more quickly and more easily than the method heretofor employed. The objects for the present invention are carried out without dismantling the joint that requires repair.

It is another object of the present invention to provide an improved high pressure glue injector in which the plunger is easily removed to fill the injector with glue and to clean the injector after use.

SUMMARY OF THE INVENTION

The present invention provides a novel, high pressure glue injector having several features that in combination comprise the present invention. These features are briefly described as follows: (1) Opposed finger grips that are elongated so as to each accommodate one or two fingers.

(2) A resilient disc, washer and bolt, which bolt is threaded into the front end of the piston. The resilient disc and washer provide a tight seal to prevent glue from passing around the resilient disc, behind the piston and into the vacinity of the plunger shaft.

(3) A novel tapered nozzle which is threaded on the front end of the glue injector barrel to receive glue from the barrel and dispense the glue under pressure through the nozzle orifice to the article to be repaired.

(4) A rear opening in the body of the glue injector through which the plunger is inserted into the injector and which is sized such that the plunger can be moved rearwardly and withdrawn from the barrel. This allows easy filling of the injector with viscous glue, and after use easy cleaning of the barrel and plunger.

In an embodiment of the invention there are provided second opposed finger grips that are elongated so as to each accommodate one finger and are disposed forward of the first finger grips. The second finger grips provide means for applying additional force when the plunger has been pushed halfway or more into the barrel. The second finger grips can also be grasped to assist in removing the plunger from the barrel.

Accordingly, one embodiment of the invention is a hand held glue injector comprising: (a) a barrel for housing glue to be injected having a front end and a rear end; (b) a plunger comprising a shaft that is received within the barrel and has a front end which carries a piston and a rear end which carries a head that is adapted to fit within the palm of the hand, and there is threaded into the front end of the piston a bolt, carrying a resilient disc and washer; and (c) a handle member having (i) a central body through which an axial aperture extends, said aperture having a front end into which the rear end of the barrel is received, and a rear section of smaller diameter than the front section and through which the shaft of the plunger extends and through which the plunger can be removed, and (ii) a first pair of opposed finger grips that are elongated to each accommodate two fingers, said finger grips extending outwardly from the rear section of the central body and, optionally, (iii) a second pair of opposed finger grips that are elongated to each accommodate one finger, said second finger grips extending outwardly from the front section of the central body and being disposed forward of the first pair of finger grips; and a tapered nozzle attached to the front end of the barrel.

The high pressure glue injector is conveniently used by first drilling a hole in the portion of a broken joint to be repaired and then placing the tapered end of the nozzle in the hole and then forcing glue under pressure through the drilled hole such that it flows into the broken joint to effect repair of the joint. The size hole drilled into the furniture to be repaired and the orifice opening of the tapered nozzle can be selected such that the desired amount of glue is introduced into the joint that is to be repaired.

After application of the glue to the joint, the members to be joined should be tied, clamped or otherwise held together until the glue has cured or hardened.

The pressurized application of the glue to the joint fills the hole of the joint and/or areas between the members to be joined with glue without taking the joint or members apart.

BRIEF DESCRIPTION OF THE DRAWINGS

The advantages of the present invention will become apparent from the consideration of the following detailed description taken in connection with the accompanying drawings, wherein a preferred embodiment of the invention is illustrated.

In the drawings, the reference numerals denote corresponding parts throughout the several views.

In the drawings,

FIG. 1 is a part sectional and part raised view of an embodiment of the glue injector of the invention.

Figure 1:
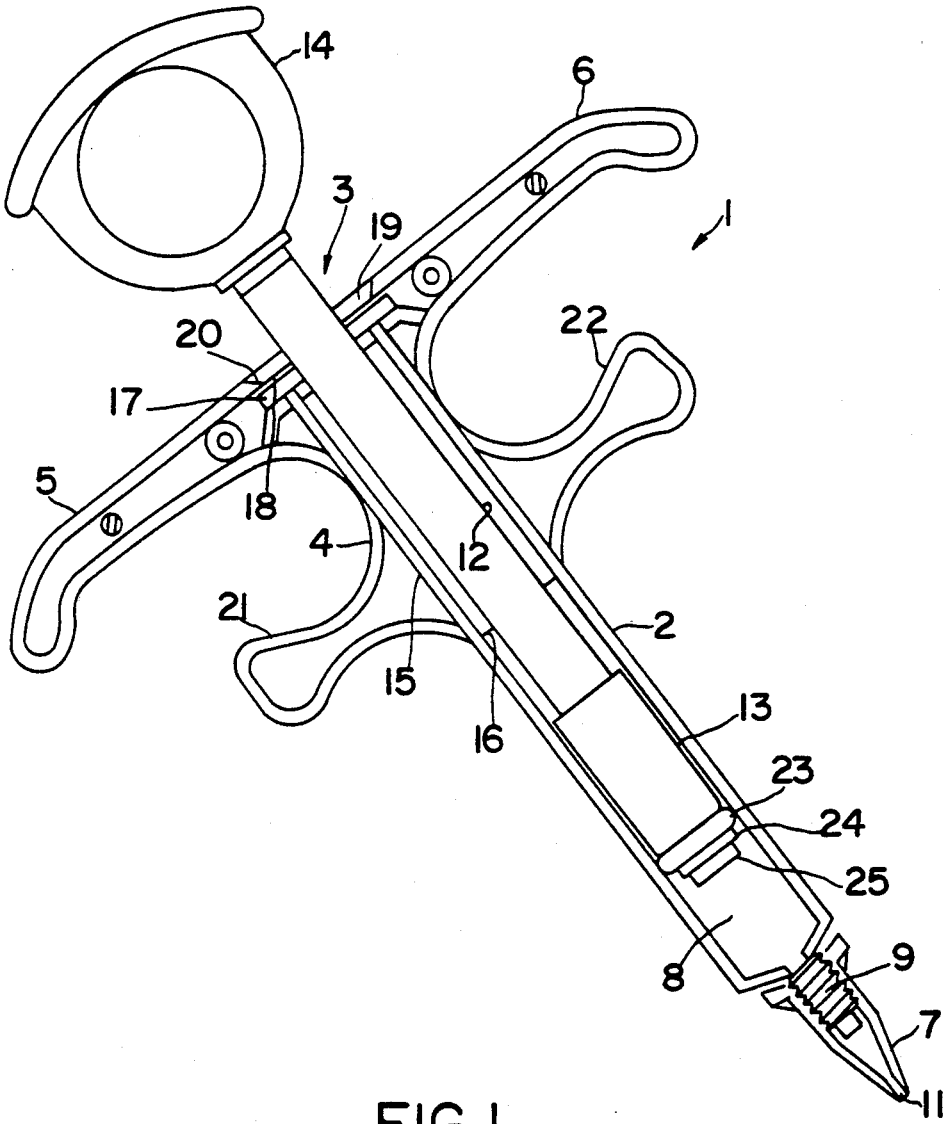

FIG. 2*a, b* and *c* is a sectional view of the principle parts of the glue injector of FIG. 1.

Figure 3:
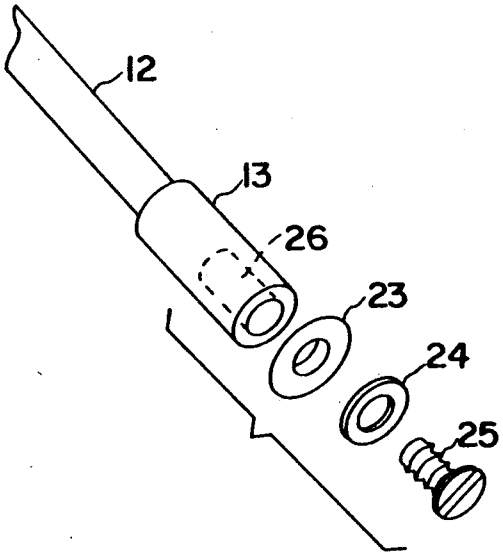

FIG. 3 is an expanded prospective view of the front end of the FIG. 2(*a*) plunger.

Figure 4:
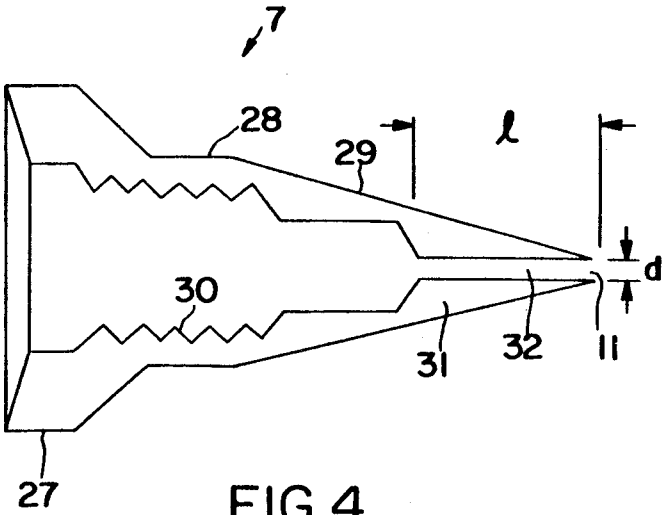

FIG. 4 is an enlarged sectional view of the tapered nozzle of FIG. 2(*b*).

DETAILED DESCRIPTION OF THE INVENTION

The FIGS. 1 and 2 of the drawings depict a preferred embodiment of the glue injector of the present invention, generally designated 1. Glue injector 1 basically has four components: a cylindrical barrel 2, a plunger 3, a body 4 with opposed finger grips 5 and 6 and a tapered nozzle 7.

The hollow portion 8 of barrel 2 is adapted to hold the glue to be injected. The front end of the barrel 2 terminates in a small diameter threaded means 9 to which is connected tapered nozzle 7 having a small orifice 11 at its outer end.

Plunger 3 consists of a shaft 12 whose front end carries a cylindrical piston member 13 that sealingly fits within barrel 2 and is adapted to drive the glue out of barrel 2 during operation of the glue injector. The shaft 12 may be splined to increase its strength and decrease its weight. The rear end of the shaft 12 carries a ring-shaped head 14 that is adapted to fit within the palm of the hand. The ring-shaped head acts as a finger grip for retracting the plunger and as a thumb grip in the event it is desired to push the plunger with force exerted by the thumb rather than the palm.

The central body portion 4 has an axial bore 15 at the front end extending therethrough and a pair of opposed finger grips 5 and 6. Bore 15 has a front section opening 16 of sufficient diameter to accommodate barrel 2. As seen in FIGS. 1, 2(*a*) and 2(*b*) the rear end of the barrel carries a rectangular flange 17 that is seated in a channel 18 formed in body portion 4. Bore 15 has a rear section opening 19 of smaller diameter than front section 16 but of sufficient size for the plunger shaft 12 and piston 13 to pass therethrough. The rear section of bore 15 opens into a recess 20 in the rear surface of the handle that is configured so that the base of head 14 can nest therein when the plunger is completely depressed. Finger grips 5, 6 are in the shape of horizontally outwardly extending arms and are of sufficient length to accommodate a comfortable grip of the handle by the second, third, fourth and fifth fingers.

Second finger grips 21 and 22 are in the shape of horizontally outwardly extending arms and are of sufficient length and shape to accommodate a comfortable grip of the handle by the second and third fingers if the thumb is used, or if the palm is used the third and fourth fingers.

FIG. 3. The detailed structure of the piston 13 is described with reference to FIGS. 1, 2(*c*) and 3. The piston 13 comprises resilient disk 23, washer 24 and threaded bolt 25. The resilient disk and washer are threadedly attached to the front end of piston 13 by bolt 25 which passes through openings in the center of the resilient disk and the washer and is threaded into opening 26 in piston 13.

FIG. 4. The detailed design and structure of the tapered nozzle 7 is shown in the enlarged view of the nozzle. The tapered nozzle 7 comprises base portion 27, body portion 28, tapered nozzle portion 29, threaded portion 30, tip portion 31, orifice 11 and orifice passage 32. The design and construction of the proportions of the tapered nozzle are important features of the present invention. The length (1) of orifice passage 32 relative to the diameter (d) of the orifice 11 determines the viscosity of the glue that can be used and the pressure build up in the nozzle and the injector barrel. The taper of the tapered nozzle determines the size of the hole that must be drilled to dispense the glue. The taper of the nozzle and the length to diameter ratio of the orifice passage and the orifice diameter dictate the mass of nozzle structure available in the tip portion 31 of the nozzle and the strength of the nozzle against breakage due to the high pressure of the glue in the nozzle. Because of the foregoing structural requirements of the nozzle it is preferred that the nozzle be machined from metals such as brass, aluminum, steel or copper, with brass being preferred.

An example of a preferred embodiment of the invention is described below.

The glue injector, to be useful, should have a comfortable fit with the palm and fingers, and should be of such design as to allow the application of sufficient force to inject relatively viscous and viscous glues in sufficient amounts to accomplish the desired repairs.

The barrel must be sufficiently strong to contain the high pressure that occurs when the plunger is pushed to inject the glue. The plunger must have sufficient shaft strength to prevent buckling or deformation when the plunger is pushed to inject glue. The barrel and plunger can be conveniently made of high impact strength polycarbonate thermo plastic material. Suitable materials are capable of withstanding internal pressures in the barrel of 600 psi or more.

The inner diameter of the barrel can be about 1.25 centimeters and the barrel can have a length about 10 centimeters. The barrel, when full and after insertion of the plunger, can contain about 10 cc of glue.

The opposed finger grips can be about 11.5 cm across, i.e. from end to end.

The second opposed finger grips can be about 6.75 cm across, i.e. from end to end.

The plunger can be about 13.5 cm with the head being about 3 cm, the shaft about 7.5 cm and the piston about 2 cm in length. The resilient disc can be about 0.3 cm thick and about 1.3 cm in diameter. The washer can be about 0.08 cm thick and about 1.2 cm in diameter, and can be made from stainless steel, brass, aluminum or plastic, with stainless steel being preferred. The bolt can similarly be made from stainless steel, brass, aluminum or plastic, with stainless steel being preferred. The outer diameter of the piston can be about 1.2 cm, which is about the same as the inside diameter of the barrel.

The resilient disc is made from a suitably resilient material such that when pressure is applied to inject the glue as the pressure builds up between the piston and the tapered nozzle the washer pushes against the resilient disc causing the disc to be compressed in thickness but to expand radially outwardly such that the outer periphery of the disc is forced against the inner surface of the barrel thereby providing an effective seal against leakage of the glue around the seal. The greater the pressure applied by the piston against the glue, the greater the radially outward expansion of the periphery of the resilient disc and the better the seal between the piston and the inner surface of the barrel.

An advantage of using the resilient disc as means to provide an effective seal is that when the pressure is released the outer periphery of the disc contracts, reducing the pressure against the inner surface of the barrel, making it easier to withdraw the plunger from the barrel.

A preferred resilient disc material is made from an ethylene propylene polymer made into the form of an O-ring. Suitable o-rings for use in the present invention are available from Parker Seals, Lexington, Ky.

The design and construction of the tapered nozzle constitutes an important feature of the present invention.

The tapered nozzle must be of sufficient strength to withstand the high glue pressures at the small diameter orifice of the nozzle.

The overall length of the nozzle can conveniently be about 2.3 cm with the outside diameter of the base being about 1.3 cm. The important part of the design is the selection of the ratio of length (1) of the orifice passage 32 to diameter (d) of the orifice 11.

The taper of the nozzle, e.g. the sharpness of the nozzle tip, determines the size of hole that must be drilled and the depth to which the nozzle tip can penetrate into the hole.

The length to diameter ratio of the orifice passage 32 determines the pressure build-up in the barrel and at the tip of the glue injector and the viscosity of the glue that can be used.

The longer the length (1) and the smaller the diameter (d) requires the use of low viscosity glues. The shorter the length (1) and the larger the diameter (d), the higher the viscosity of the glue can be.

Within these parameters, however, the portion 31 of the tapered nozzle must be sufficiently strong to withstand the high pressures to which it is subjected. In order for the tapered nozzle to have the necessary strength, it is preferably machined from metals such as brass, steel, copper or aluminum. Brass, however, is preferred.

Applicant has found that the orifice passage length (1) can be 0.40 to 0.80 cm, preferably about 0.60 cm, and the inner diameter (d) of the tapered nozzle orifice passage can be 0.05 to 0.20 cm, and preferably 0.08 to 0.16 cm.

Advantageous use has been made of a tapered nozzle having an orifice passage length (1) of about 0.60 cm and an inner diameter of 0.08 cm for use with medium and low viscosity glue and an inner diameter (d) of 0.16 cm for use with medium and high viscosity glue.

The length (1) to diameter (d) ratio that can be used can be 10:1 to 4:1, and preferably 8:1 to 5:1..

Tapered nozzles of the following dimensions of the orifice passage 32 can be used.

| Length | Diameter | Use |
|---|---|---|
| 1. 0.80 cm | 0.06 cm | Low Viscosity Glue |
| 2. 0.60 cm | 0.12 cm | Medium Viscosity Glue |
| 3. 0.40 cm | 0.18 cm | High Viscosity Glue |

Because the nozzles are threadedly attached to threaded means 9 of the barrel 2, appropriate nozzles can be selected for use with glues of different viscosities.

Suitable glues that can be used in accordance with the present invention are yellow wood glue having a viscosity of 4000–5000 Cps (Brookfield, no. 3 spindle, 12 rpm, 77° F.) and all purpose white glue having a viscosity of 3500–4000 Cps (Brookfield, no. 4 spindle, 60 rpm, 80° F.).

The invention is not to be limited by the foregoing description and it is understood that the invention may be modified within the scope of the appended claims without departing from the invention. Having thus described the inventions, what I claim as new and desire to secure by letters patent is:

I claim:

1. A high pressure glue injector comprising:

(a) a barrel for housing glue to be injected having a front end and a rear end;

(b) a plunger comprising a shaft that is received within the barrel and has a front end which carries a piston and a rear end which carrries a head that is adapted to fit within the palm of the hand; said piston having at its outer end a resilient disc, washer and bolt which is passed through the waster and resilient disc and threaded into the front end of the piston to have the resilient disc provide a tight seal and prevent glue form passing around the seal and into the vicinity of the shaft;

(c) a handle member having (i) a central body having a front surface and a rear surface through which an axial aperture extends, said aperture having a front end into which the rear end of the barrel is received and a rear end through which the plunger shaft and piston may be completely withdrawn, and (ii) a pair of elongated opposed finger grips which accomodate at least two fingers and that extends outwardly from the rear section of the central body; and (d) a tapered nozzle attached to the front end of the barrel having a small orifice 0.05 to 0.20 cm in diameter and an orifice passes 0.40 to 0.80 cm in length through which glue is injected.

2. The glue injector of claim 1 wherein the tapered nozzle is threadedly attached to the front end of said barrel whereby the nozzle may be removed and replaced with another nozzle of different orifice diameter.

3. The glue injector of claim 1 wherein the head at the rear end of the shaft of the plunger is ring-shaped and forms an enclosed opening that provides a thumb grip.

4. The glue injector of claim 1 wherein the small oriface and oriface passage have a length to diameter ratio of the oriface passage to the orifice diameter of 10:1 to 4:1.

5. The glue injector of claim 1 wherein the front end of the barrel terminates in a small diameter threaded means to which the tapered nozzle threadedly attaches.

6. A high pressure glue injector comprising:

(a) a barrel for housing glue to be injected having a front end and a rear end;

(b) a plunger comprising a shaft that is received in the rear end of the barrel and has a front end which carries a piston and a rear end which carries a ring-shaped head that is adapted to fit within the palm of the hand, said piston having at its outer end a resilient disc, washer and bolt which is passed through the washer and resilient disc and threaded into the end of the piston to have the resilient disc provide a tight seal and prevent glue from passing around the seal and into the vicinity of the shaft;

(c) a handle member having (i) a central body through which an axial aperture extends, said aperture having a front end into which the rear end of the barrel is received, and (ii) a pair of opposed finger grips that are elongated to accommodate two fingers, said finger grips extending outwardly from the rear section of said central body; and (d) a tapered nozzle threadedly attached to the front end of the barrel whereby the nozzle may be removed and replaced with another nozzle, said tapered nozzle having a small orifice 0.05 to 0.20 cm in diameter and an orifice passage 0.40 to 0.80 cm in length through which glue is injected, wherein the length to diameter ratio of the orifice passage to the orifice diameter is 10:1 to 4:1, wherein said plunger is removable from the rear end of the barrel to provide means for filling the barrel with glue.

7. The glue injector of claim 6 wherein the front end of the barrel terminates in a small diameter threaded means to which the tapered nozzle threadedly attaches.

8. The glue injector of claim 6 wherein the length to diameter ratio of the orifice passage to the orifice diameter is 8:1 to 5:1. .

9. The glue injector of claim 6 wherein the head at the rear end of the shaft of the plunger is ring-shaped and forms an enclosed opening that provides a thumb grip.

* * * * *